US005921573A

United States Patent [19]

Challande et al.

[11] Patent Number: 5,921,573

[45] Date of Patent: Jul. 13, 1999

[54] SUPPORT ASSEMBLY FOR A SKI BINDING

[75] Inventors: Christian Challande, Cruseilles; Pierre Desarmaux, Evires, both of France

[73] Assignee: Salomon S.A., Metz-Tessy, France

[21] Appl. No.: 08/604,614

[22] Filed: Feb. 21, 1996

[30] Foreign Application Priority Data

Mar. 3, 1995 [FR] France ..... 95.02856

[51] Int. Cl.[6] ..... A63C 9/00

[52] U.S. Cl. ..... 280/636; 280/607; 280/633

[58] Field of Search ..... 280/636, 620, 280/607, 633

[56] References Cited

U.S. PATENT DOCUMENTS

| | | | |
|---|---|---|---|
| 3,743,310 | 7/1973 | Smolka | 280/11.35 C |
| 3,829,112 | 8/1974 | Spademan | 280/636 |
| 4,088,345 | 5/1978 | Korger | 280/636 |
| 4,951,961 | 8/1990 | Boussemart et al. | 280/636 |
| 5,078,419 | 1/1992 | Wittmann et al. | 280/636 |
| 5,092,622 | 3/1992 | Wladar et al. | 280/636 |
| 5,106,115 | 4/1992 | Wladar et al. | 280/636 |
| 5,722,681 | 3/1998 | Merino et al. | 280/634 |

FOREIGN PATENT DOCUMENTS

| | | | |
|---|---|---|---|
| 0031740 | 7/1981 | European Pat. Off. | A63C 9/085 |
| 612546 | 8/1994 | European Pat. Off. | 280/636 |
| 0634197 | 1/1995 | European Pat. Off. | A63C 9/00 |
| 0653231 | 5/1995 | European Pat. Off. | A63C 9/085 |
| 2105872 | 4/1972 | France | A63C 9/00 |
| 2329309 | 5/1977 | France | A63C 9/00 |
| 2652508 | 4/1991 | France | 280/636 |
| 2663856 | 1/1992 | France | A63C 9/08 |
| 2666748 | 3/1992 | France | A63C 9/08 |
| 3624387 | 7/1987 | Germany | 280/636 |
| WO91/09654 | 7/1991 | WIPO | A63C 5/075 |
| WO92/00126 | 1/1992 | WIPO | A63C 9/00 |

*Primary Examiner*—Robert J. Oberleitner
*Assistant Examiner*—Tyrone M. Lee
*Attorney, Agent, or Firm*—Greenblum & Bernstein, P.L.C.

[57] ABSTRACT

The invention relates to a boot support device on a gliding board such as a ski. A support plate translationally movable along a transverse direction of the ski is overlaid by a support element of the boot that is rotationally movable about a longitudinal axis with respect to the support plate. A reverse construction is possible, the goal being to combine a translational displacement and a rotational displacement.

21 Claims, 5 Drawing Sheets

1
2
3
4
5
6
7
9
10
11
13
15
16
III
III
X'
X 81
90

85
75
86
80
78
83
84
79
87
82
88
89
X'
71
70
73
72
74
71
76
77
X

SUPPORT ASSEMBLY FOR A SKI BINDING

BACKGROUND OF THE INVENTION

1. Field of the Invention

The present invention relates to a support element provided to be inserted between a gliding board and a boot retained in a releasable manner on the gliding board in the practice of sports such as skiing, surfing or the like.

The invention is also related to a retention element comprising such a support element.

2. Description of Background and Relevant Information

In the case of a ski, the boot is maintained on the ski by means of a front retention element and a rear retention element.

Each retention element has a jaw that is movable against the return force of a spring. The jaw is borne by a body, which is itself connected to the ski by a base plate. The jaw is provided to retain an end of the boot, and to release such end in the case of excessive biases.

The boot rests at the front and rear on a support element. The front support element plays a particularly important role.

Indeed, in the case where the front retention element is biased to release the boot, the front portion of the boot then accomplishes a relative movement with respect to the retention element along a lateral direction of the ski.

The prior art has been proposed support elements that have an upper portion movable along a transverse direction to accompany the front of the boot during its lateral release.

Such support elements allow for a better control of the friction between the boot and the ski, to the extent that the friction that delay the release of the boot are located between two movable elements of the support element instead of being located between the boot and the ski.

In some cases, the movement of the support element can modify the intensity of the return force that the spring opposes to the boot release.

Such support elements are described, for example, in the published French Patent Application No. 2 663 856, and in the published European Patent Application No. EP 31 740.

A support element movable with respect to a base about a longitudinal axis is also known from the patent application published as WO 91/09654. Such a support element, according to this document, improves the linkage between the boot and the ski to have a good contact with snow.

SUMMARY OF THE INVENTION

An object of the present invention is to improve the existing movable support elements to facilitate the release of the boot.

Another object of the invention is to propose a simple, inexpensive and easily obtained construction.

A boot support device, according to the invention, is adapted to be associated with an element for retaining the boot on the board. The retention element copmrises a retaining jaw borne by a body, the assembly being movable at least laterally, the device comprising a support plate that is rotationally movable over a limited amplitude about a longitudinal axis.

According to the present invention, the support plate is topped by a support element and the support element is movable along the support plate in a transverse direction.

An inverted arrangement of the support plate and support element is also contemplated.

In such a case, the boot support device, according to the invention, is adapted to be associated with an element for retaining the boot on a board, the retention element comprising a retaining jaw borne by a body, the assembly being movable at least laterally, the device comprising a support plate movable in transverse direction.

The support plate of the support device is overlaid by a support element that is rotationally movable with respect to the support plate over a limited amplitude about a longitudinal axis.

In both cases, the advantage is that the two functions of transverse mobility and rotational mobility about a longitudinal axis are combined to facilitate the lateral release of the boot, particularly in the case where the front of the boot has a tendency to twist in its retaining jaw.

BRIEF DESCRIPTION OF THE DRAWINGS

Other characteristics and advantages of the invention will be better understood upon reading the description that follows and with reference to the annexed drawings giving, by way of example, several embodiments applied to a ski boot.

DETAILED DESCRIPTION OF THE PREFERRED EMBODIMENTS

Figure 1:
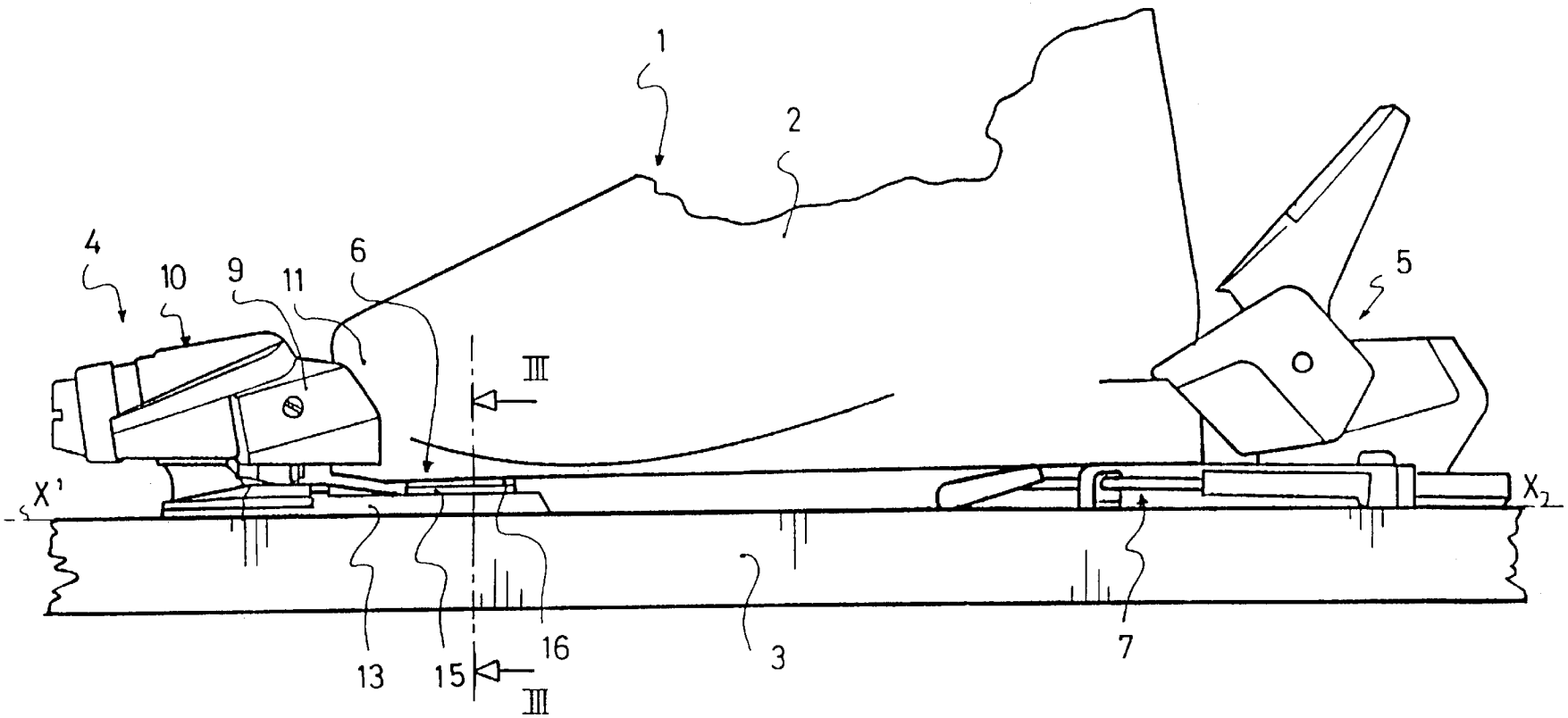
FIG. 1 is a view of a retention assembly of a boot on a ski.

FIG. 1 represents an assembly 1 that includes a boot 2 maintained on a ski 3 by front 4 and rear 5 retention elements or devices, such as ski bindings.

The boot 2 and ski 3 are represented partially without it being detrimental to the description of the invention. The length of the ski defines a reference longitudinal axis X-X' located, for example, on the upper surface of the ski 3.

Reference character X is located toward the rear of the ski 3, whereas character X' is located toward the front of the ski 3.

Boot 2 is supported on front 6 and rear 7 support devices.

Each of the support devices 6 and 7 corresponds to the spirit of the invention. Therefore, it will be sufficient to describe only one thereof hereinafter, for example, the front support device 6.

On the front side 11 of boot 2, a base plate 13 affixed to ski 3 is connected to both the front support device 6 and a front retention element 4 well known to the one with ordinary skills in the art.

The front retention element 4 comprises a body 10 fixed with respect to ski 3 and a jaw 9 movable with respect to body 10 against the action of a spring not shown.

The jaw 9 maintains the front portion 11 of boot 2 in position on the front support device 6.

By analogy, on the rear side of the boot 2, a base plate affixed to ski 3 is connected to the rear support device 7 and to a rear retention element 5, which likewise comprises a fixed body and a movable jaw against the action of a spring.

Such a retention element 5 is well known to one skilled in the art and maintains the rear portion of the boot 2 in position on the rear support device 7.

Boot 2 is therefore immobilized with respect to ski 3 in normal operating conditions.

However, the boot 2 sometimes separates from the ski 3, particularly in a front-torsion fall. In this case, the jaw 9 of the front retention element 4 moves with respect to ski 3 to allow for the separation of boot 2, and the support device 6 behaves in a manner that facilitates this separation.

Figure 2:
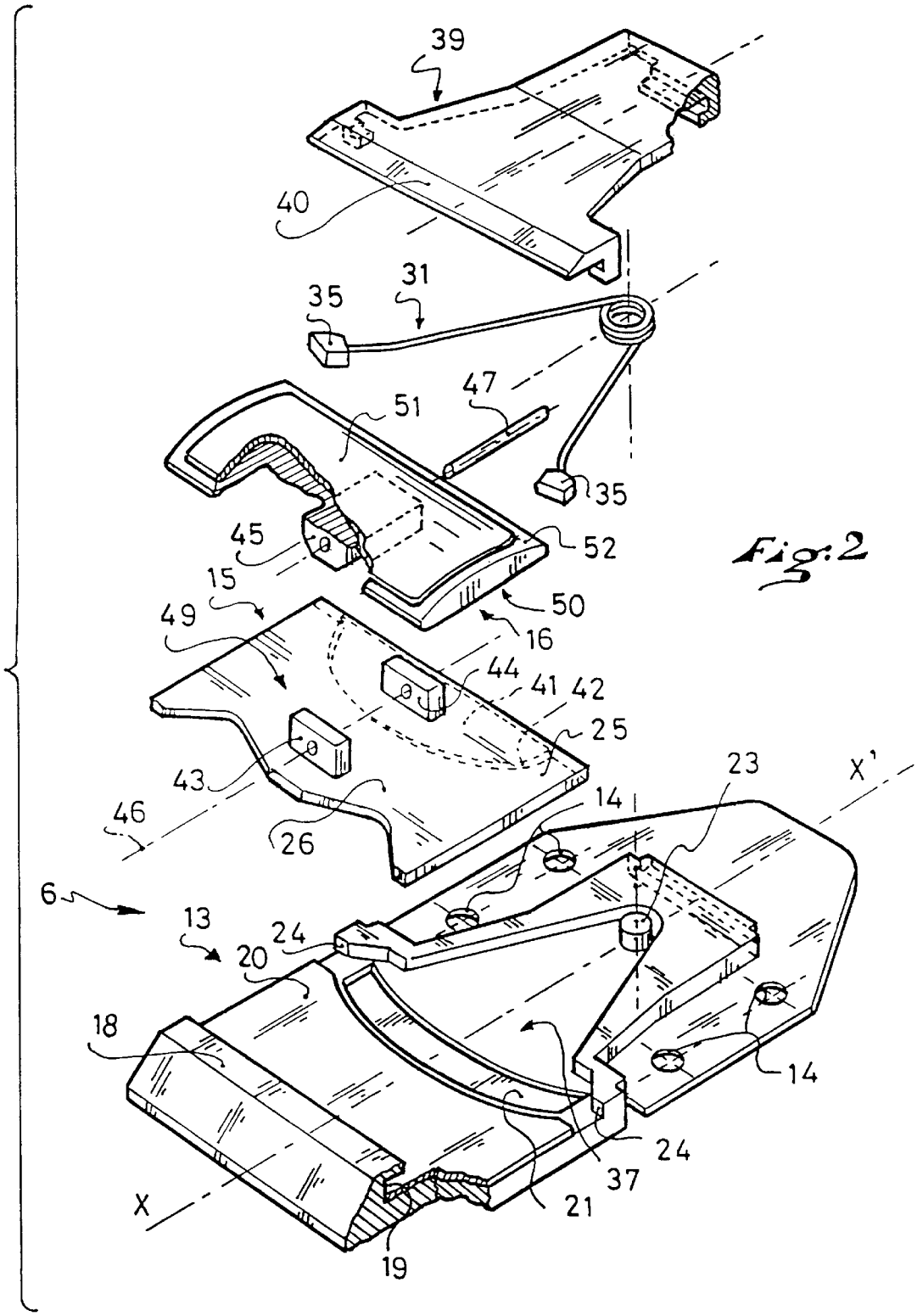
FIG. 2 is an exploded view of the support device.

A non-limiting example of support device is shown in an exploded view in FIG. 2. It is, in this case, the front support device 6 that comprises a rotationally movable support means cooperating with a translationally movable support means on base plate 13.

Axis X-X' makes it possible to locate a longitudinal direction of base plate 13; it is oriented along the length of the ski.

The base plate 13 is maintained on the ski 3 not represented by means that can be screws passing through four openings 14 of base plate 13.

The translationally movable support means is presented, for example, in the form of a plate 15 provided to cooperate with base plate 13 in the manner of a drawer.

Such a device and its operation mode are described in the Applicant's document No. WO 92/00126.

The support plate 15 takes support on base plate 13 through a film 20 with a low friction coefficient. However, the film 20 is not indispensable.

A rear tongue 26 of support plate 15 is inserted in a groove 19 of base plate 13, whereby it is vertically retained by a tongue 18.

A front tongue 25 of support plate 15 comes into contact with edge zones 24 of base plate 13, and a tongue 40 of a cuff 39 provided to be affixed to base plate 13.

It follows that the support plate 15 is maintained longitudinally and vertically with respect to the ski 3, while being capable of moving by translation on either side of the ski 3.

Means are provided to limit the translation amplitude and to constantly bias the support plate 15 toward a median equilibrium position of the device.

These means are represented in the form of two guide elements 35 mounted at both ends of a hairpin-shaped spring 31.

Guide elements 35 cooperate with both a curved groove 21 of base plate 13 and an edge 42 of a cavity 41 of support plate 15 to limit the translation amplitude. Spring 31 is housed in a space 37 demarcated by a cavity of the base plate 13 and cuff 39, a central coil of which is positioned on the upstanding post 23. Spring 31 constantly biases the support plate 15 to a median position by means of guide elements 35.

The support plate 15 is provided to cooperate with the rotationally movable support means which is presented, for example, in the form of a support element 16.

Means allow for the relative journal of the support plate 15 and support element 16.

These means are shown in FIG. 2 in the form of a pivoting linkage, along an axis 46 substantially parallel to axis X-X' when support plate 15 is in its median equilibrium position.

Two studs 43 and 44 are affixed to the upper surface 49 of support plate 15. A pin 45 is affixed to the lower surface 50 of support element 16. The studs 43, 44 and the pin 45 are each pierced by a hole, which allows for the passage of a rod 47 along the axis 46 for the journal of support plate 15 with respect to support element 16.

Of course, the amplitude of the relative rotational movement is limited by contact of plate 15 and element 16 at their ends.

Figure 3:
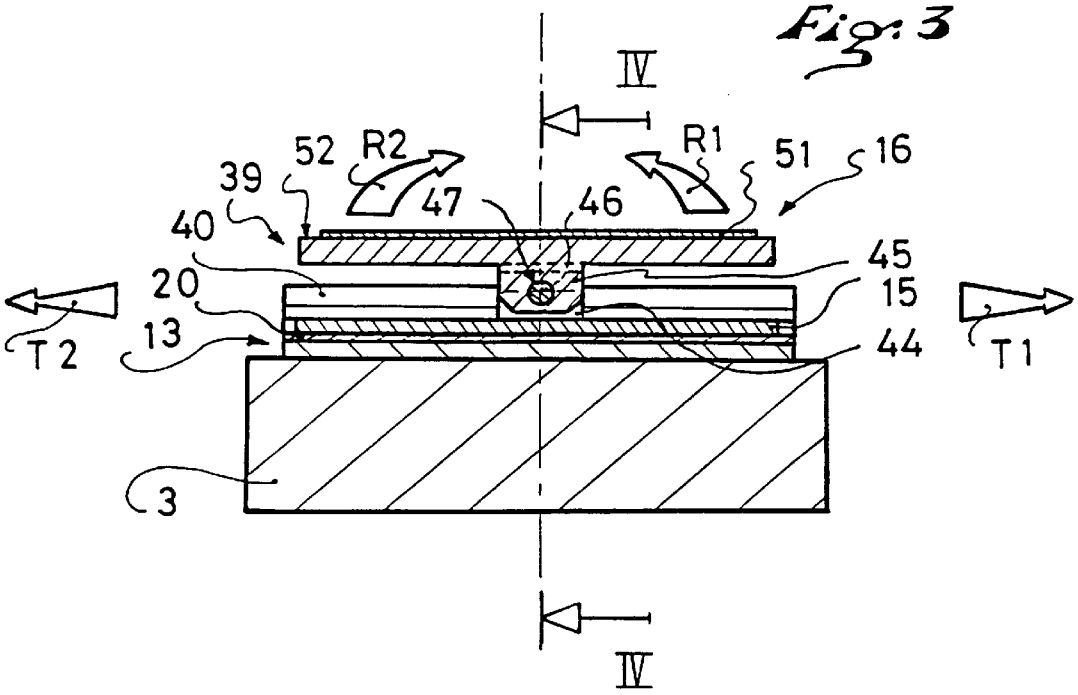
FIG. 3 is a transverse cross-section of the support device taken along line III—III of FIG. 1.

FIG. 3 makes it possible to better visualize the structure of support device 6.

Only the essential elements are shown. The base plate 13 topped by a film 20 having a low friction coefficient is connected to the upper surface of ski 3. The support plate 15 is in contact with film 20 and capable of displacing transversely, either in the direction of arrow T1, or in the direction of arrow T2. The support element 16 is capable of rotating with respect to support plate 15 along axis 46 of rod 47, in the direction of arrow R1 or in the direction of arrow R2.

A film 51 with low friction coefficient is attached on the upper surface 52 of support element 16. This film is in direct contact with boot 2 and contributes in further reducing the friction that may hinder a release of the boot in the case of a fall.

Figure 4:
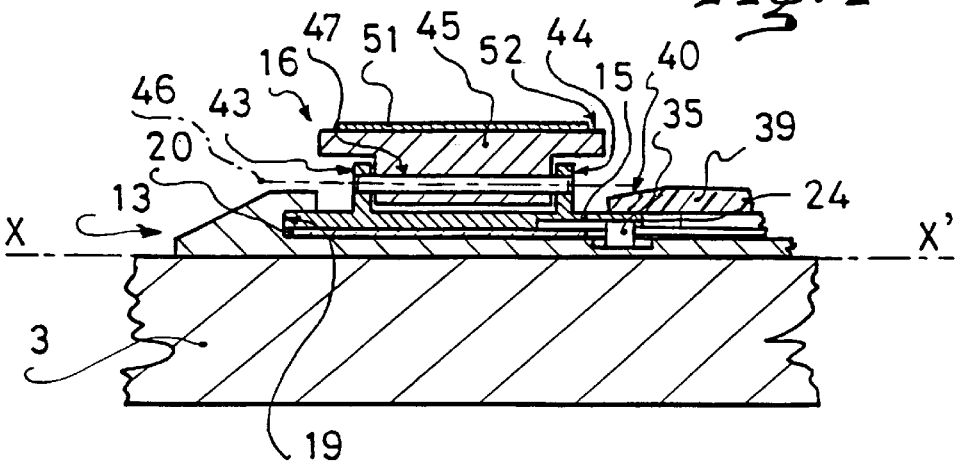
FIG. 4 is a partial longitudinal cross-section of the support device taken along line IV—IV of FIG. 3.

The cross section of FIG. 4 shows at the same time the guide elements of the support plate 15 and of the support element 16.

The support plate 15 slides on plate 13 and is guided by the groove 19, the edge zones 24 and the tongue 40 of the cuff 39.

The support element 16 pivots along axis 46 of rod 47 which passes through the studs 43, 44 and the pin 45.

When taking off the boot, the support element 16 accompanies boot 2 in a movement which is the combination of a translation and a rotation. The combined movement has the advantage of facilitating the lateral release of boot 2, particularly in the case where boot 2 has a tendency to twist in the retention element 4 about axis X-X' or a neighboring axis.

The example of embodiment that has just been described corresponds to a structure where the translationally movable element is located on the side of ski 3, whereas the rotationally movable element is located on the side of boot 2.

Figure 5:
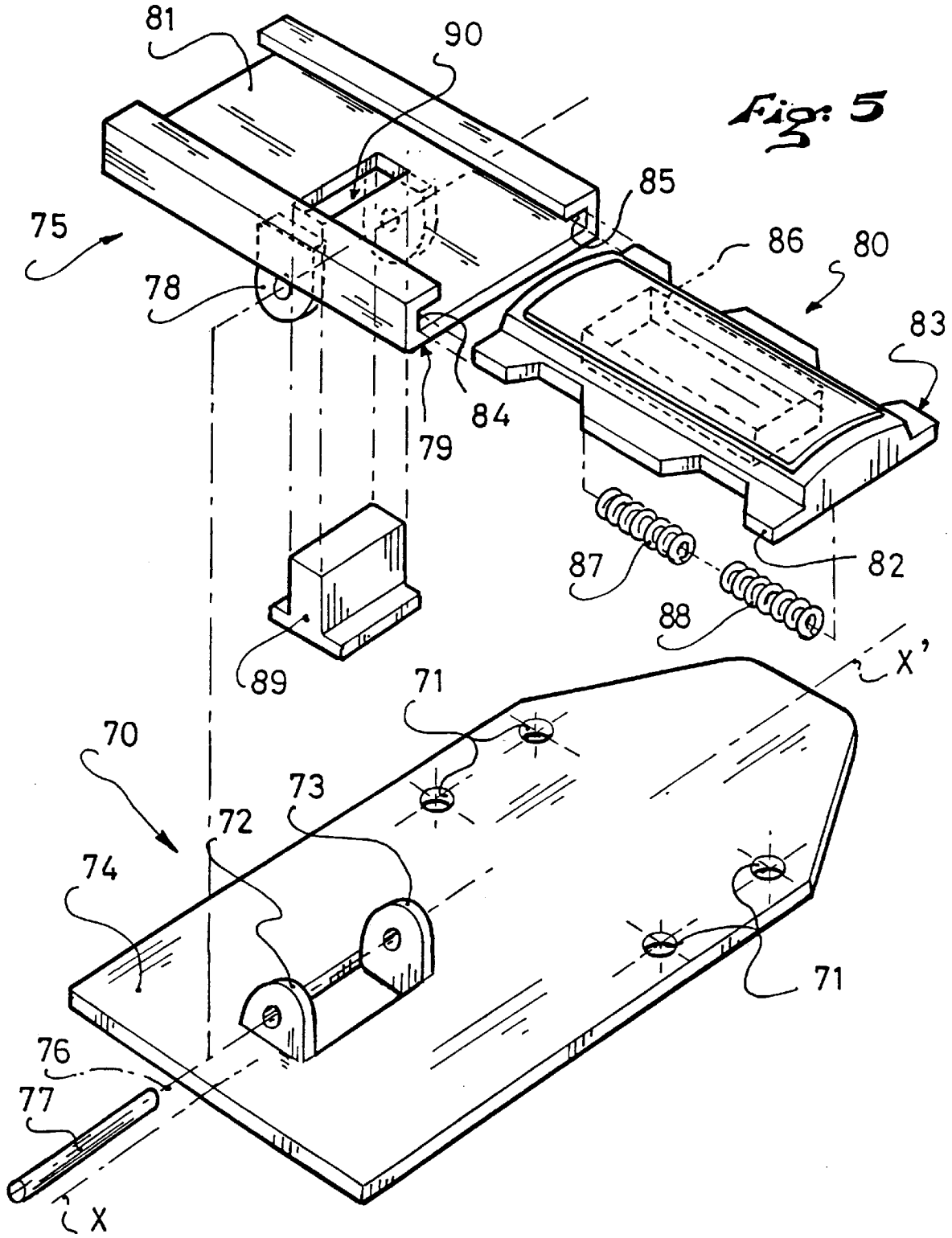
FIG. 5 is an exploded view of an embodiment variation.

One can envision a reverse arrangement, such as that proposed in FIG. 5, without leaving the scope of the invention.

A base plate 70 is maintained on ski 3 by means such as screws passing through holes 71.

A support plate 75 is connected to base plate 70 by means allowing for a relative rotation between plates 70 and 75.

These means are, for example, two studs 72 and 73 projecting on the upper surface 74 of plate 70 and are provided to be journalled along an axis 76 about a pin 77, with a cap 78 of the lower surface 79 of plate 75.

A support element 80 made of stainless steel, for example, is seated on the upper surface 81 of support plate 75, so as to be capable of moving with respect thereto along a transverse direction with respect to axis X-X'.

Two notched tongues 82 and 83 guide plate 80 in two complementary grooves 84 and 85 of plate 75.

The relative translation of plate 75 and element 80 is limited in either direction as explained hereinafter.

The support element 80 has a recess to form a cavity 86 opposite the upper surface 81 of the support plate 75.

Two helicoidal springs 87 and 88 are housed in the cavity 86 and separated by a pin 89.

Pin 89 is T-shaped. It extends beyond the cavity 86 through a slit 90 located at the base of the cap 78.

Pin 89 is immobilized by contact on the surfaces 79 and pin 77.

As element 80 moves with respect to plate 75, regardless of the direction, one of the springs 87 and 88 opposes the displacement until its coils are joined, i.e., fully compressed. At that moment, the system is in abutment.

Springs 87 and 88 are preferably identical to ensure an elastic return of support element 80 to a median position above support plate 75. This structure of a device 6 combines a rotation and a translation as in the first example.

Figure 6:
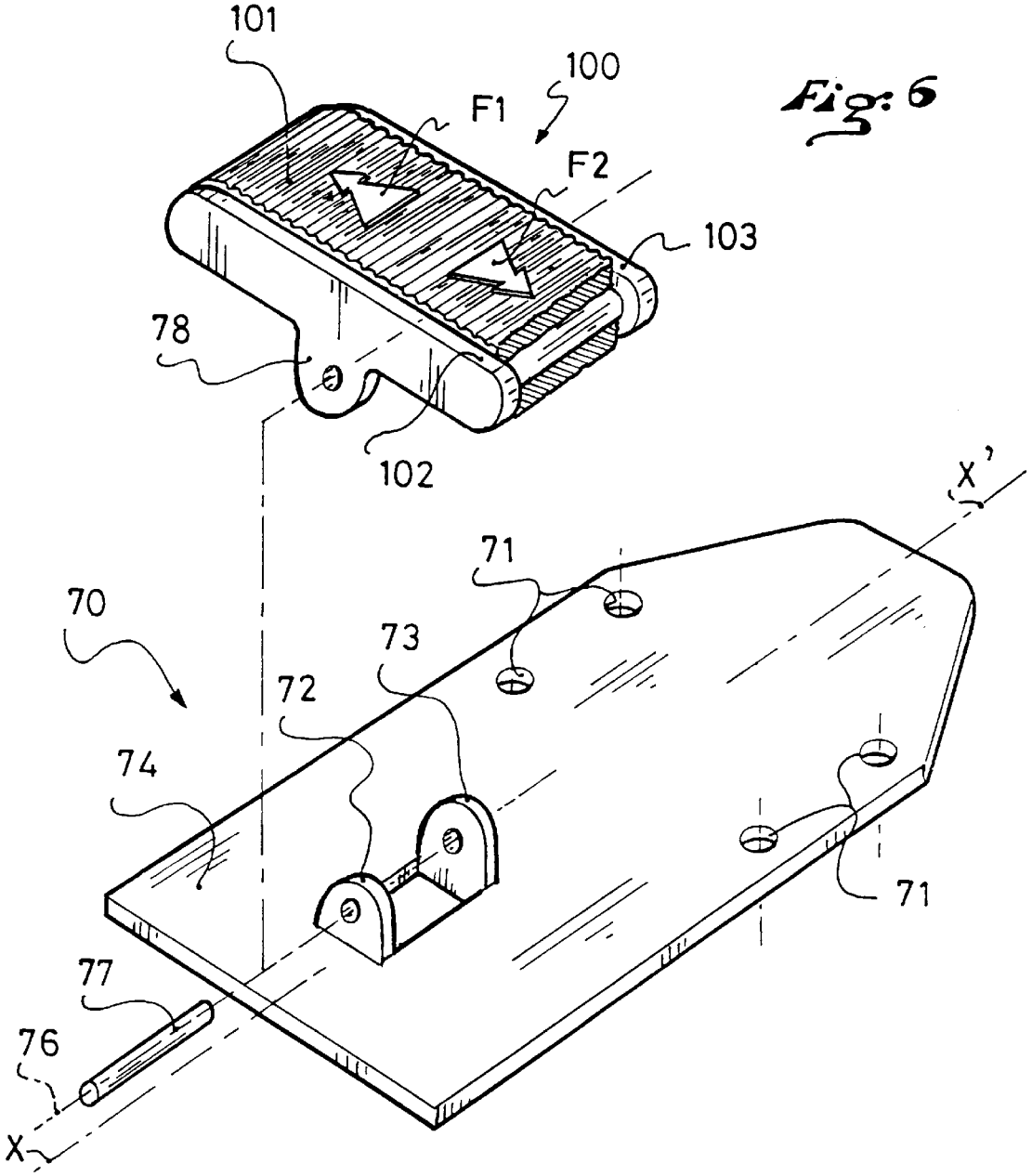
FIG. 6 is another embodiment variation.

One can propose another embodiment variation such as that described in FIG. 6.

This variation and the preceding have the following elements in common: the base plate 70 pierced by holes 71 on the upper surface 74 from which two studs 72 and 73 project, as well as pin 77 of axis 76 substantially parallel to axis X-X'.

A support plate 100 provided with a cap 78 is journalled by pin 77 on studs 72 and 73 of base plate 70 along axis 76.

A belt 101 surrounds plate 100 along a transverse direction of the ski substantially perpendicular to axis X-X'.

Belt 101 is guided by edges 102 and 103 of plate 100 so as to be capable of displacing along arrows F1 or F2 in the same fashion as a belt on a conveyor belt.

The displacement of belt 101 can be compared to a lateral translation of a support element. In the case of a fall causing a separation of the boot 2 from front retention element 4, belt 101 rotates about plate 100 at the same time as plate 100 pivots along axis 76.

In all of the examples provided, the device 6 facilitates the disengagement of boot 2 by combining a rotation and a translation.

Although the invention has been described with reference to particular means, materials, and embodiments, it is to be understood that the invention is not limited to the particulars expressly disclosed, but the invention extends to all equivalents within the scope of the claims that follow.

For example, one can provide a device 6 where a support plate is mounted directly on ski 3.

The instant application is based upon French Patent Application No. 95.02856, filed on Mar. 3, 1995, the disclosure of which is hereby expressly incorporated by reference thereto in its entirety and the priority of which is claimed under 35 USC 119.

What is claimed is:

1. A support device for a boot adapted to be associated with an element for retaining the boot on a gliding board, the retention element comprising a retaining jaw carried by a body, the assembly being movable at least laterally, the device comprising:

a support plate rotationally movable over a limited amplitude about a longitudinal axis, wherein said support plate is overlaid by a support element, and the support element is movable along the support plate along a transverse direction.

2. A support device according to claim 1, wherein:

the support element is returned elastically to a median position above the support plate by at least one spring.

3. A support device for a boot adapted to be associated with an element for retaining the boot on a board, the retention element comprising a retaining jaw carried by a body, the assembly being movable at least laterally, the device comprising a support plate movable a long a transverse direction, wherein the support plate is overlaid by a support element that is rotationally movable with respect to the support plate over a limited amplitude about a longitudinal axis.

4. A support device according to claim 3, wherein:

the support plate is returned elastically to a median position by at least one spring.

5. A support device for a boot adapted to be associated with an element for retaining the boot on a board, the retention element comprising a retaining jaw carried by a body, the assembly being movable at least laterally, the device comprising a support plate rotationally movable over a limited amplitude about a longitudinal axis, wherein the support plate is surrounded by a belt along a transverse direction of the ski, and that the belt is translationally movable along the support plate.

6. An assembly comprising a retention element for retaining a boot on a gliding board in combination with a support device according to claim 1 for supporting the boot.

7. An assembly comprising a retention element for retaining a boot on a gliding board in combination with a support device according to claim 2 for supporting the boot.

8. An assembly comprising a retention element for retaining a boot on a gliding board in combination with a support device according to claim 3 for supporting the boot.

9. An assembly comprising a retention element for retaining a boot on a gliding board in combination with a support device according to claim 4 for supporting the boot.

10. An assembly comprising a retention element for retaining a boot on a gliding board in combination with a support device according to claim 5 for supporting the boot.

11. A support device adapted to be associated with a boot retention device for retaining the boot on a gliding board, the gliding board being elongated in a longitudinal direction, said support assembly comprising:

a base plate adapted to be affixed to the gliding board;

a support plate and a connection between said support plate and said base plate, said connection comprising a first connection;

a support element and a connection between said support element and said support plate, said connection between said support element and said support plate comprising a second connection;

said first and second connections comprising connection structures to facilitate both: (1) translational movement of said support element transverse to the longitudinal direction and (2) pivoting movement of said support element about a longitudinal axis.

12. A support device according to claim 11, wherein:

said support element is located at a median position, at rest; and said support device further comprises a mechanism to elastically bias said support element to said median position.

13. A support device according to claim 11, wherein:

said first connection, between said support plate and said base plate, comprises structural elements affixed to said base plate that guide said support plate for translational transverse movement with respect to said base plate.

14. A support device according to claim 13, further comprising:

a mechanism to elastically bias said support plate to said median position.

15. A support device according to claim 11, wherein:

said second connection, between said support element and said support plate, comprises structural elements affixed to said support plate that guide said support element for translational transverse movement with respect to said support plate.

16. A support device according to claim 15, further comprising:

a mechanism to elastically bias said support element to said median position.

17. A support device according to claim 11, wherein:

said first connection, between said support plate and said base plate, comprises structural elements affixed to said base plate that constrain said support plate for pivoting movement along the longitudinal axis with respect to said base plate.

18. A support device according to claim 11, wherein:

said second connection, between said support element and said support plate, comprises structural elements affixed to said support plate that constrain said support element for pivoting movement along the longitudinal axis with respect to said support plate.

19. An assembly for retaining and supporting a boot upon a gliding board, the gliding board being elongated in a longitudinal direction, said assembly comprising:

a base plate adapted to be affixed to the gliding board;

a retention device for engaging an end of a boot, said retention device being affixed to said base plate; and a support device for supporting a sole of the boot, said support device being affixed to said base plate, said support device comprising:

a support plate and a connection between said support plate and said base plate, said connection comprising a first connection;

a support element and a connection between said support element and said support plate, said connection between said support element and said support plate comprising a second connection;

said first and second connections comprising connection structures to facilitate both: (1) translational movement of said support element transverse to the longitudinal direction and (2) pivoting movement of said support element about a longitudinal axis.

20. An assembly according to claim 19, wherein:

said retention device is a front binding for engaging a front end of a boot, said support device being affixed to said base plate rearward of said front binding.

21. An assembly according to claim 19, wherein:

said retention device is a rear binding for engaging a rear end of a boot, said support device being affixed to said base plate forward of said rear binding.

* * * * *